US007748533B2

(12) United States Patent
Van Marle et al.

(10) Patent No.: US 7,748,533 B2
(45) **Date of Patent: *Jul. 6, 2010**

(54) SYSTEM COMPRISING SEVERAL PACKAGES OF CANDY BARS AND HOLDER THEREFOR

(75) Inventors: Niels Van Marle, Noord-Brabant (NL); Ronald Lewerisa, Noord-Brabant (NL)

(73) Assignee: Mars Incorporated, McLean, VA (US)

( * ) Notice: Subject to any disclaimer, the term of this patent is extended or adjusted under 35 U.S.C. 154(b) by 946 days.

This patent is subject to a terminal disclaimer.

(21) Appl. No.: 10/544,707

(22) PCT Filed: Feb. 10, 2004

(86) PCT No.: PCT/EP2004/050110

§ 371 (c)(1),
(2), (4) Date: Jul. 10, 2006

(87) PCT Pub. No.: WO2004/071895

PCT Pub. Date: Aug. 26, 2004

(65) Prior Publication Data

US 2007/0160717 A1 Jul. 12, 2007

(30) Foreign Application Priority Data

Feb. 12, 2003 (EP) ..... 03100311

(51) Int. Cl.

| | |
|---|---|
| ***B65D 73/00*** | (2006.01) |
| ***B65D 75/58*** | (2006.01) |
| ***B65D 5/52*** | (2006.01) |
| ***B65D 77/02*** | (2006.01) |

(52) U.S. Cl. ..... 206/495; 206/739; 206/748; 206/749; 206/760; 426/108; 426/115

(58) Field of Classification Search ..... 206/739, 206/743, 745–750, 759–760, 526, 495; 229/87.01–87.15; 426/108–120

See application file for complete search history.

(56) References Cited

U.S. PATENT DOCUMENTS

| | | | | |
|---|---|---|---|---|
| 1,448,435 | A * | 3/1923 | Davis | 206/748 |
| 1,719,681 | A | 7/1929 | Wiebusch | |
| 1,866,323 | A | 7/1932 | Russell | |
| 1,929,615 | A * | 10/1933 | Tanner | 206/743 |
| 2,198,138 | A | 4/1940 | Sutton | |
| 2,560,520 | A | 7/1951 | Berkson | |
| 4,070,489 | A * | 1/1978 | Pahnke | 426/115 |
| 4,109,826 | A * | 8/1978 | Maisonneuve | 426/115 |
| 4,666,079 | A * | 5/1987 | Bolli et al. | 229/87.05 |
| 5,188,223 | A * | 2/1993 | Brose et al. | 206/760 |

FOREIGN PATENT DOCUMENTS

| | | |
|---|---|---|
| EP | 1022233 | 7/2000 |
| GB | 1598670 | 9/1981 |

* cited by examiner

*Primary Examiner*—Bryon P Gehman
(74) *Attorney, Agent, or Firm*—Fitzpatrick, Cella, Harper & Scinto

(57) ABSTRACT

A system comprising several packages (4) for one or more candy bars or other similar products, as well as a holder (7) for the packages (4), with the special feature that the holder (7) comprises at least two panels (12) being hingeably connected to each other along adjacent edges thereof, wherein each panel (12) engages at least one package.

14 Claims, 4 Drawing Sheets

SYSTEM COMPRISING SEVERAL PACKAGES OF CANDY BARS AND HOLDER THEREFOR

The invention relates to a system comprising several packages for one or more candy bars or other (similar) products, as well as a holder for said packages.

The invention particularly refers to such a holder with which packaged candy bars or similar snack products, can be transported, stored and displayed in a shop.

It is noted that the present invention is not restricted to candy bars as packaged products, but extends to any other packaged product, such as petfood, M&M's®, etcetera.

It has been usual heretofore to pack such packaged products, such as the known Mars® or Snickers® bars which are packed in a tubular foil envelope, in cardboard display boxes, wherein a plurality of display boxes are then packed into a transport box for transport and storage. In this manner the product is packed in three packing layers, i.e. the product packaging, the display box and the transport box. It will be apparent that such a method of packaging requires much packaging material, which is undesirable from cost and environmental considerations. Such a method of packaging is moreover relatively labour-intensive during both packing and unpacking.

The invention has for its object a system for transport, storage and display (presentation) sale of such packaged products which is less expensive, wherein less packing material is necessary, and/or which is less labour-intensive.

In order to accomplish that objective, a system of the kind referred to in the introduction according to the invention is characterized in that said holder comprises at least two panels being hingeably connected to each other along adjacent edges thereof, wherein each panel comprises engaging means for engaging at least one package. Particularly, the panels are hingeable relative to each other between a display position wherein the panels are mutually in line, and a transport position wherein the panels are turned towards each other in a zigzag-manner. A significant advantage of such holders is that when they are used both the display boxes and the transport boxes are unnecessary, because the holders with the products are suitable for stacking in for instance containers during transport and storage. Each holder is particularly provided with a plurality of engaging means in the form of outwardly extending flaps, so that a plurality of candy bars or similar products can be engaged in their holding position. From a commercial (esthetic) point of view each candy bar is preferably engaged in a horizontal holding position.

In one preferred embodiment of a system in accordance with the invention the holder is at least substantially made of a cellulose containing material, preferably cardboard or paper.

In another preferred embodiment of a system according to the invention the holder is made in one piece, wherein the panels are hingeably connected to each other along a weakening line, particularly a folding line or a perforation line.

In another preferred embodiment of a system in accordance with the invention the holder comprises sleeve means for packaging the panels in the transport position. Such a sleeve means may have the form of a cardboard or paper sleeve as a single unit.

In another preferred embodiment of a system according to the invention each package is made of a substantially rectangular foil sheet, a first part of which, near a first cathetus (rectangular side) thereof, is adhered to a second part, near a second cathetus (rectangular side) positioned opposite said first cathetus (rectangular side), thus forming a tubular envelope comprising a longitudinal seal positioned outside said tubular envelope, which tubular envelope is closed at both ends; and in a holding position of each package the engaging means extend between said tubular envelope and said longitudinal seal. The engaging means preferably comprise at least one flap extending outwardly relative to the panel.

As said longitudinal seal is present outside the tubular envelope, whose ends are closed (for example by means of a transversal seal), a "pocket" is formed, being particularly suited for receiving said engaging means in order to firmly engage the package.

In another preferred embodiment of a system in accordance with the invention each panel comprises supporting means for supporting said tubular envelope in the holding position, wherein the supporting means comprise at least one flap extending outwardly relative to the panel. In case a panel holds a plurality of candy bars, each candy bar is supported by an adjacent (underlying) candy bar, except for the lowest (underlying) candy bar. For the latter candy bar and in case the panel holds only one candy bar, additional supporting means as mentioned above may be necessary.

In another preferred embodiment of a system according to the invention the flap of the engaging means in the holding position extends at least substantially parallel to the panel, wherein the flap of the supporting means in the holding position extends at least substantially perpendicular to the panel.

In a further preferred embodiment of a system in accordance with the invention the flap(s) is/are made of a flexible material. Preferably, the flap(s) is/are made of an elastic material, so that the flap(s) is/are capable of recovering orientation and shape after deformation. Particularly, the flap(s) can be hinged about a hinge axis, for example a folding line or perforation line present in the holder.

In a further preferred embodiment of a system according to the invention the flap(s) is/are in one piece with the holder. The holder is preferably made of a plate-like material, such as cardboard, paper or a plate-like synthetic material etcetera.

The invention is also related to a holder to be used in a system in accordance with the invention.

The invention also refers to a method for holding together for transport, storage and/or displaying at a retail outlet at least one package for one or more candy bars or other (similar) products, using a holder for said package, characterized in that said holder is provided with at least two panels being hingeably connected to each other along adjacent edges thereof, wherein at least one package is engaged by engaging means provided on each panel.

The invention will now be further elucidated with reference to an embodiment shown in the figures, wherein FIG. 1 is a perspective view of a packaged candy bar;

Figure 4:
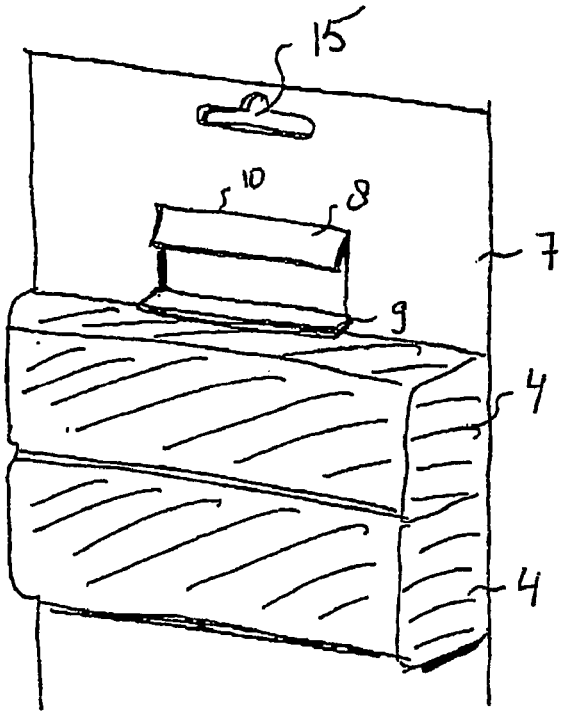
FIG. 4 shows a perspective view of a holder according to the invention, while holding two candy bars of FIGS. 1, 2 and 3 (FIG. 4)
Figure 6:
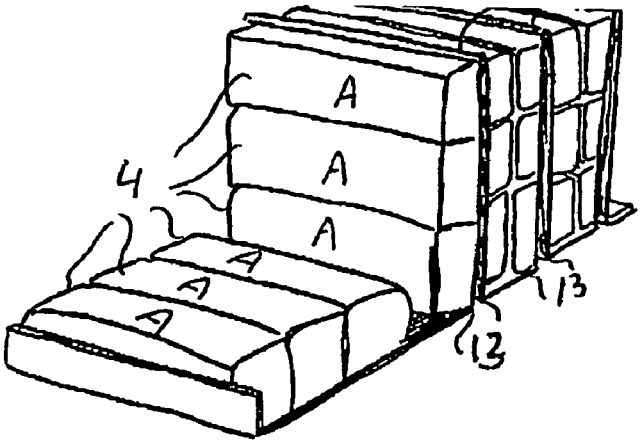
Figure 7:
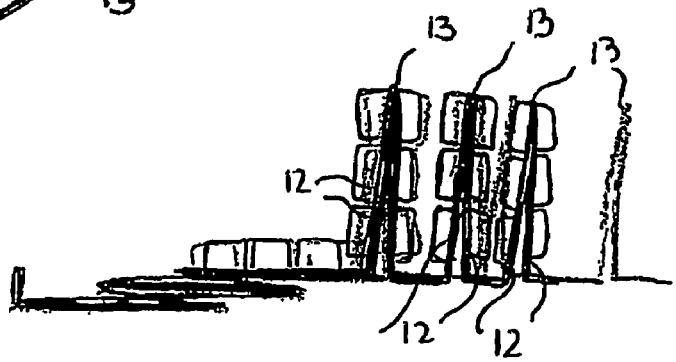
Figure 8:
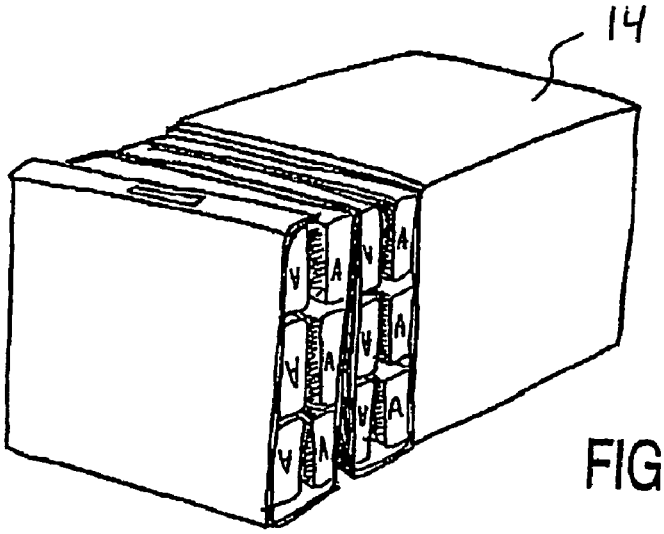
Figure 9:
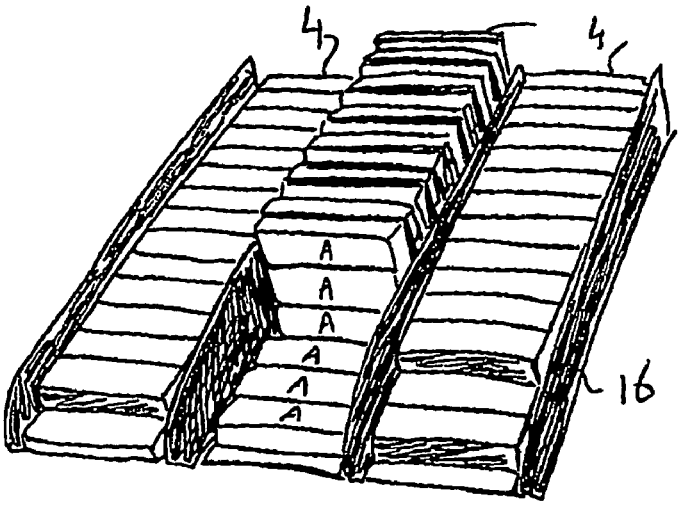
Figure 10:
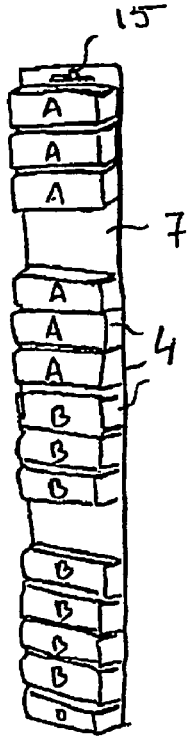
Figure 11:
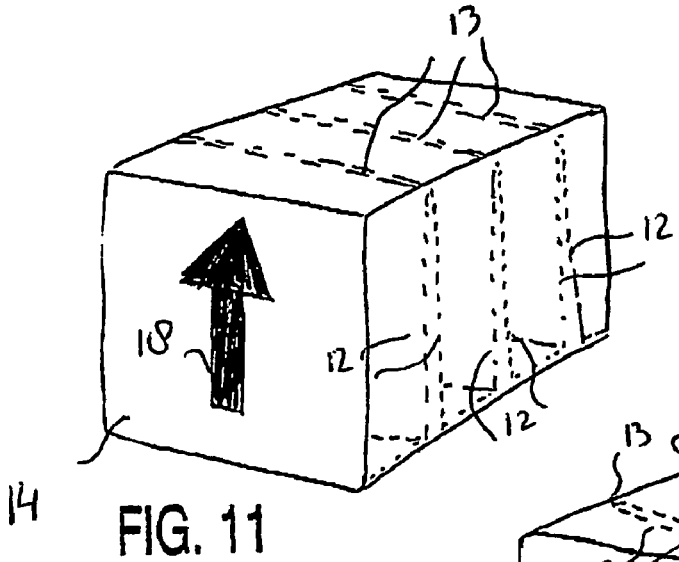
Figure 12:
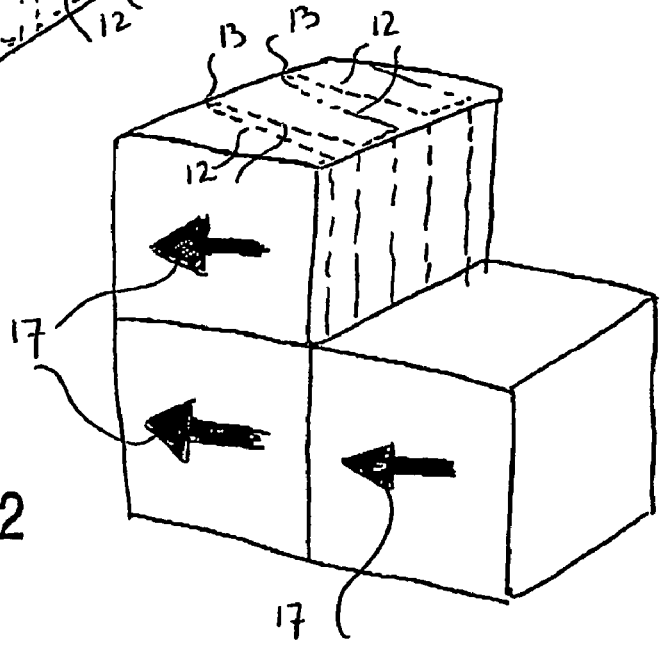

FIGS. 6 and 7 refer to a perspective and a cross-sectional view, respectively, of the holder of FIG. 4 with panels turned towards each other;

FIG. 8 shows the holder of FIGS. 6 and 7 with a sleeve mounted on it;

FIG. 9 relates to a shelf or display device in a shop with candy bars on the holder of FIG. 8;

FIG. 10 corresponds with FIG. 4, but shows the holder in full stretched position; and FIGS. 11 and 12 are perspective views of the holder of FIG. 8 ready to be placed on a shelf or display device of a shop and in transport direction, respectively.

Figure 1:
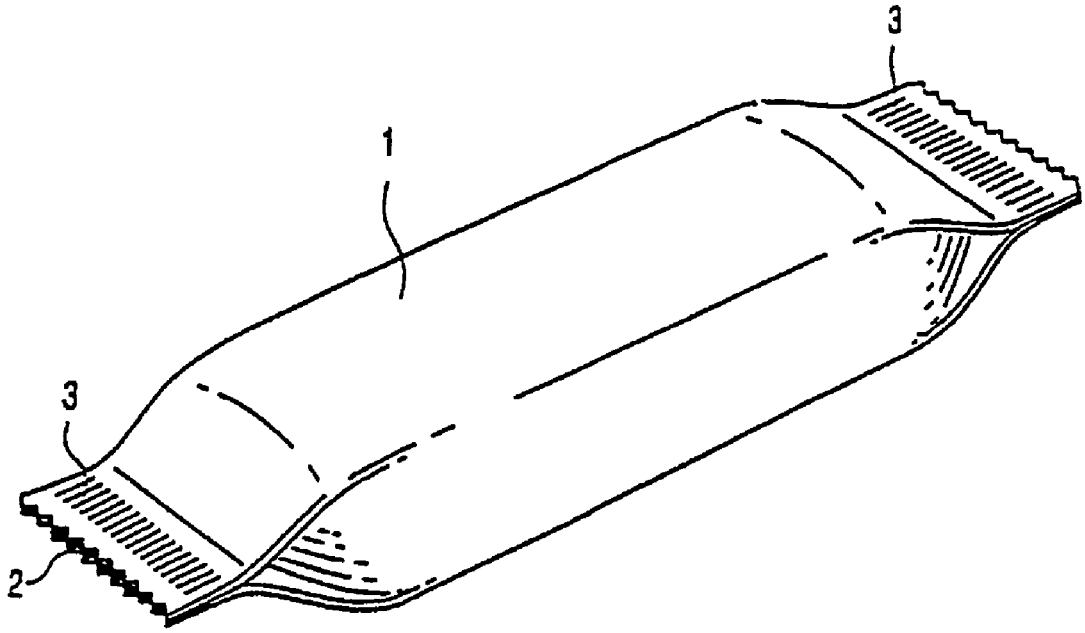

FIG. 1 is a perspective view of a package which contains one or more candy bars. The package consists of a foil sheet 1, which comprises a longitudinal seal 2, only the end of which is visible in FIG. 1. Said longitudinal seal forms a tubular envelope, whose ends are closed by means of a seal 3.

Figure 2:
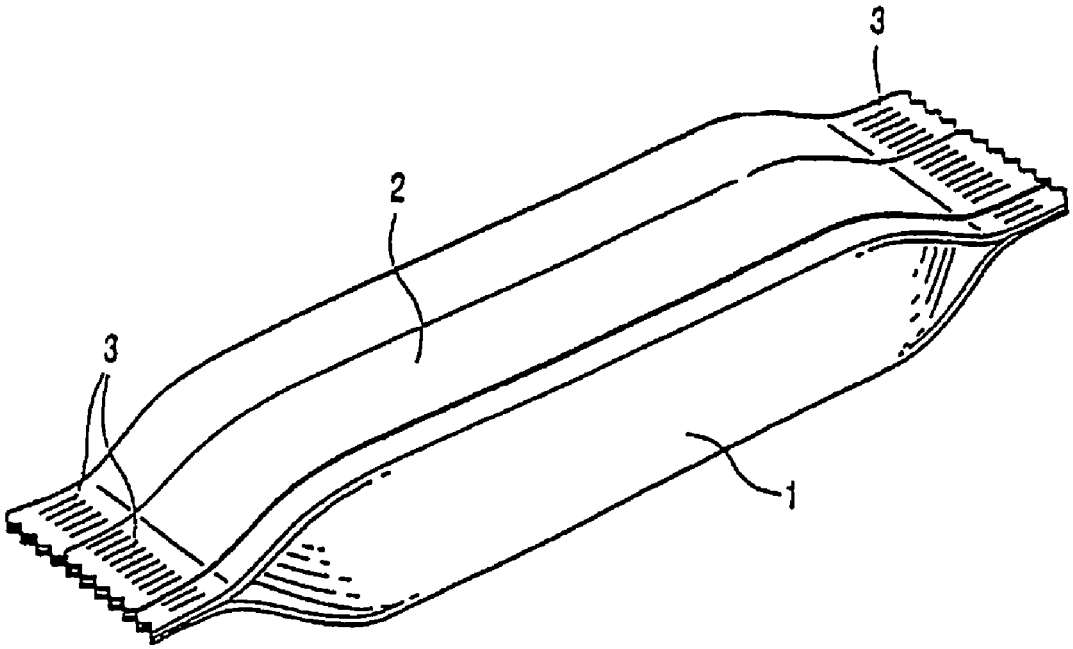
FIG. 2 shows the same package in another position.

The longitudinal seal 2 is present outside the tubular envelope and butts flat against the package, as is shown in FIG. 2.

Figure 3:
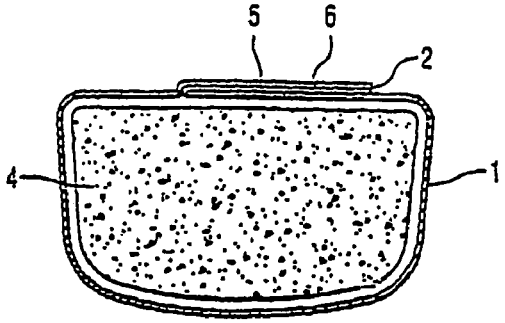
FIG. 3 is a cross-sectional view of a packaged candy bar.

FIG. 3 is a cross-sectional view of a candy bar 4, which is packaged in the foil 1 as shown in FIG. 2. As shown in FIG. 3, two parts 5,6 of the foil 1 (first part 5 and second part 6) are adhered together by means of an adhesive, so that parts 5,6 together form the longitudinal seal 2, which butts flat against the package of the candy bar 4. The second part 6 thereby butts against the outer side of said tubular envelope.

Figure 5:
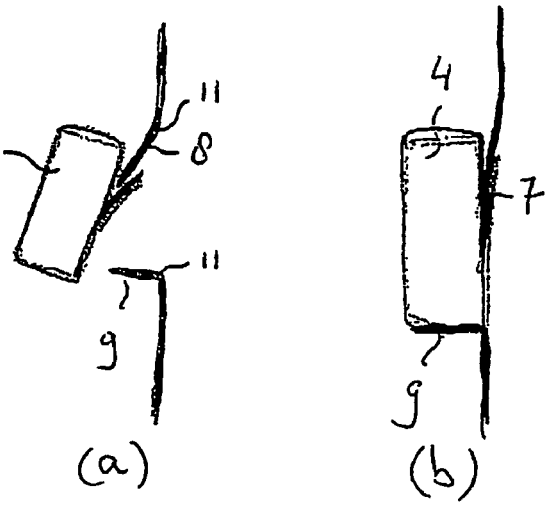
FIG. 5 is a schematic cross-sectional view of the holder of FIG. 4 with only one candy bar.

In FIG. 4 is shown a flat holder 7 made of cardboard, wherein a plurality of rectangular flaps or panels are cut out. Each pair of flaps 8,9 serves to hold a packaged candy bar 4 in its horizontal holding position. Both flaps 8,9 are able to hinge about a hinge axis formed by a folding line 10,11 made in the holder 7. In order to hold the candy bar onto the holder 7 the flap 8, extending outwards relative to the holder 7, has to engage the package between the tubular envelope and the longitudinal seal 2 (FIG. 5*a*). The flap 8 is then hinged toward the holder 7 until it extends more or less parallel to the holder 7 in the horizontal holding position of the candy bar (FIG. 5*b*). For supporting the candy bar 4 in its horizontal holding position the flap 9 extends more or less perpendicular to the holder 7, so that it bears the candy bar 4 (FIG. 5*b*). As the holder 7 holds a plurality of candy bars 4, each candy bar 4 is supported by an adjacent (underlying) candy bar 4 as well, except for the lowest (underlying) candy bar 4.

FIGS. 6 and 7 show a perspective view and a cross-sectional view, respectively, of the holder 7 made in one piece of cardboard and consisting of a plurality of panels 12 being hingeable relative to one another along folding lines 13 so as to form a zigzag-configuration of panels 12. In FIG. 8 the holder 7 is shown in a transport position, wherein a cardboard sleeve 14 is slid over the holder 7. As can be seen from FIGS. 6, 7 and 8, each panel 12 engages in a horizontal holding position a plurality of candy bars 4 (also designated with reference "A"), whereas in said transport position the panels 12 are turned towards each other, so that pairs of adjacent panels 12 are facing one another (FIG. 8).

FIG. 10 corresponds with FIG. 4, on the understanding that in FIG. 10 the holder 7 is drawn in a full stretched display position, wherein all panels 12 are mutually in line, i.e. are lying in the same flat plane. The holder 7 serving as a display package of the candy bars in a retail outlet is hung in a shop with the help of a point of suspension 15.

Candy bars 4 of FIG. 10 are designated with references "A" and "B".

FIG. 9 refers to a situation wherein the candy bars 4 with the holder 7 as shown in FIGS. 6, 7 and 8 are shown on a shelf 16 in a shop.

In FIG. 12 three units as shown in FIG. 8 are depicted in a transport position, wherein the zigzag-configuration as mentioned above is directed in the direction of arrow 17 (i.e. the unit shown in FIG. 8 is turned over 90°). In that position the zigzag-configuration is able to compensate strong forces. FIG. 11 shows the unit of FIG. 8 ready to be placed on a shelf of a retail outlet. The zigzag-configuration is then directed in the direction of arrow 18.

When using said holders 7 the use of both display boxes and transport boxes is avoided, because the holders 7 with the candy bars are suitable for stacking in for instance containers during transport and storage.

The invention claimed is:

1. A system comprising several packages for one or more candy bars, as well as a holder for said packages, wherein said holder comprises a plurality of panels being hingeably connected to each other along adjacent edges thereof between a display position wherein the panels are mutually in line, and a transport position wherein the panels are turned towards each other in a zigzag-manner, wherein each panel comprises engaging means for engaging at least one of said packages;

wherein each package is made of a substantially rectangular foil sheet, a first part of which, near a first cathetus thereof, is adhered to a second part, near a second cathetus positioned opposite said first cathetus, thus forming a tubular envelope comprising a longitudinal seal positioned outside said tubular envelope, which tubular envelope is closed at both ends; and wherein each package is in a holding position when engaged with one of the plurality of panels and in a holding position of each package the engaging means extend between said tubular envelope and said longitudinal seal.

2. A system according to claim 1, wherein the holder is at least substantially made of a cellulose containing material.

3. A system according to claim 2, wherein the cellulose containing material is cardboard or paper.

4. A system according to claim 1, wherein the holder is made in one piece and wherein the panels are hingeably connected to each other along a weakening line.

5. A system according to claim 4, wherein the weakening line is a folding line or a perforation line.

6. A system according to claim 1, wherein the holder comprises sleeve means for packaging the panels in the transport position.

7. A system according to claim 1, wherein the engaging means comprise at least one flap extending outwardly relative to each panel.

8. A system according to claim 7, wherein said at least one flap of the engaging means in the holding position extends at least substantially parallel to each panel and wherein the flap of the supporting means in the holding position extends at least substantially perpendicular to each panel.

9. A system according to claim 7, wherein said at least one flap is made of a flexible material.

10. A system according to claim 9, wherein said at least one flap can be hinged about a hinge axis.

11. A system according to claim 7, wherein said at least one flap is made of an elastic material.

12. A system according to claim 11, wherein said at least one flap can be hinged about a hinge axis.

13. A system according to claim 7, wherein said at least one flap is in one piece with each panel.

14. A system according to claim 1, wherein each panel comprises supporting means for supporting said tubular envelope in the holding position and wherein the supporting means comprise at least one flap extending outwardly relative to each panel.

* * * * *